United States Patent [19]

Bernhoft et al.

[11] 4,165,613

[45] Aug. 28, 1979

[54] CONTROL APPARATUS FOR A PLURALITY OF SIMULTANEOUSLY ACTUATABLE FLUID MOTORS

[75] Inventors: Gerald W. Bernhoft, Wauwatosa; Thomas J. Limbach, Milwaukee, both of Wis.

[73] Assignee: Koehring Company, Brookfield, Wis.

[21] Appl. No.: 890,229

[22] Filed: Mar. 27, 1978

[51] Int. Cl.[2] ..... F15B 13/06; F15B 13/09

[52] U.S. Cl. ..... 60/420; 60/486; 91/461; 91/532; 414/699

[58] Field of Search ..... 60/486, 420, 421; 91/461, 444, 412; 214/762, 138 R

[56] References Cited

U.S. PATENT DOCUMENTS

| | | | |
|---|---|---|---|
| 3,606,049 | 9/1971 | Gordon | 214/762 X |
| 3,863,448 | 2/1975 | Purdy | 60/422 |
| 3,987,622 | 10/1976 | Johnson | 60/420 |

*Primary Examiner*—Edgar W. Geoghegan

[57] ABSTRACT

A control apparatus is disclosed for permitting simultaneous actuation of a plurality of fluid motors whose combined flow capacity exceeds the available flow rate. The plurality of fluid motors are actuated by a corresponding plurality of open center, pressure-compensated, pneumatically actuated control valves which are connected in series flow arrangement with a fluid supply having a fixed minimum flow output and a maximum flow rate output. A device is provided to sense the rate of flow for hydraulic fluid exhausting from the series of control valves. The rate of flow sensing device controls a pneumatic pressure regulator that provides a corresponding pressure change in the pneumatic supply pressure provided to a plurality of control valves.

10 Claims, 1 Drawing Figure

CONTROL APPARATUS FOR A PLURALITY OF SIMULTANEOUSLY ACTUATABLE FLUID MOTORS

BACKGROUND OF THE INVENTION

The present invention relates to an hydraulic control system for an excavating device. More particularly, the present invention concerns an hydraulic control system which automatically proportions the available flow of hydraulic fluid between a plurality of fluid actuators when the fluid flow rate demand exceeds the available fluid supply.

There now exist numerous types of hydraulically operated construction machinery. For example, hydraulically powered cranes, excavating devices, rollers and the like are commonplace in the construction industry. Typically, these hydraulically actuated machines use hydraulic actuators or fluid power motors to perform a plurality of functions, which may occur simultaneously. As an example, in an excavator, the boom may be raised or lowered, the boom may be articulated, and an earth engaging bucket may be articulated relative to the distal end of the boom. Each of these functions is performed by a different hydraulic cylinder and all may occur simultaneously.

In the design of such hydraulically actuated machines, it is impractical to provide a driving engine and a fluid pressure source having sufficient flow capacity to accommodate all of the hydraulic actuators at their maximum demand flow rates. This impracticality is due in part to the expense and the weight of the engine and pumps which would otherwise be required. Accordingly, it is desirable to provide a fluid pressure source and associated driving engine having an output capacity which is less than the combined maximum flow required when each fluid actuator operates at maximum demand. However, when the total actuator demand exceeds the available pump output capacity, operation of the hydraulically actuated devices becomes erratic for the condition where total actuator demand exceeds the pump capacity: for example, the most highly loaded fluid motor may practically stop further extensional movement until a less highly loaded actuator has attained the end of its actuating stroke. Such abrupt changes in flow distribution between the plurality of actuators, cause an abrupt change in the behavioral characteristics of the machine as seen from the operator's station. Moreover, in close quarter maneuvers, such abrupt changes may lead to accidental damage of either the machine or an adjacent structure.

In the past, efforts have been made to match the output of a variable displacement pump to the flow demand requirements of a plurality of series connected, pressure compensated valves. In one example, the exhaust flow from the pressure compensated valves passes through a restriction which generates a differential pressure that operates an hydraulically controlled pilot valve. The pilot valve causes a corresponding movement of a fluid actuator that increases or decreases the displacement of a variable displacement pump. See, for example, U.S. Pat. No. 3,863,448, issued to Purdy on Feb. 4, 1975.

Such a device does not operate to adjust the actuation of the plurality of actuators when their combined flow exceeds the maximum available output from the variable displacement pump. Moreover, there is no maintenance of flow proportions associated with the plurality of fluid actuators.

Many of the problems discussed above are also present when a plurality of actuator control valves are connected in parallel flow relationship. In one prior device, a plurality of closed center control valves regulate a pneumatic pilot pressure in response to two parameters: the total flow rate demand of the fluid actuators and the maximum pressure acting on any one of the fluid actuators. See, for example, U.S. Pat. No. 3,987,622, issued to Johnson on Oct. 26, 1976.

Devices which sense the maximum load pressure exerted in an hydraulic system must be large and heavy in order to withstand very high hydraulic pressures which approach the maximum pressure for which a device is designed. Moreover, the components required to effect the control functions are also unduly expensive by virtue of the necessity of handling the high pressures and the requisite sealing problems.

In view of the foregoing, it will be apparent that the need continues to exist for a truly effective control system to regulate a plurality of simultaneously actuated hydraulic motors so as to proportionally adjust and slow the movement of all actuators while efficiently using pumps and providing a low pressure control system having an open center such that the pressurized fluid is continuously available without delay.

SUMMARY OF THE INVENTION

A plurality of pneumatically actuated, pressure compensated, open center, fluid power control valves are connected in series type fluid communication with a fluid power source. Each fluid power control valve operates a corresponding fluid actuator. In addition, a plurality of relay actuated pilot valves and a manually actuated pilot valve are connected in communication with a source of pneumatic pressure and with a corresponding one of the pneumatic actuators for the fluid power control valves.

In order to determine the demand of the plurality of fluid actuators in comparison to the available flow capacity from the fluid supply, a flow rate sensing means is connected to the discharge port of the last fluid power control valve in the series. With the open center construction of the fluid power control valves, pressurized fluid is exhausted from the last of the control valves as long as the fluid demand is less than the pump capacity. On the other hand, if there is no flow from the exhaust port, then the fluid demand exceeds the fluid capacity. The flow rate sensing means passes an hydraulic signal to an hydraulically actuated pneumatic pressure control valve which is connected in a pneumatic supply line feeding the plurality of pilot relay valves and the pilot valve from the source of pneumatic pressure and which lowers the pressure of the pneumatic fluid.

In order to add stability to the pneumatic supply system in the presence of the pressure reducing control valve, a choke check valve may be installed in series flow relationship with the pressure reducing control valve on the downstream side thereof.

By providing the fluid power source with a minimum fixed flow rate which can be increased to a maximum flow rate, the control system has a continuously available pressure head which can be utilized by the fluid power control valves to effect operation of the corresponding fluid actuators.

In addition, by arranging the fluid power actuators and their respective relay and control valves such that the actuator with the lowest maximum flow demand is closest to the fluid power supply and the actuator with the highest maximum fluid demand is most remote from the fluid power supply, flow demand requirements are normally portioned so as to not exceed the maximum capacity of the fluid power supply. In this manner, the maximum demand requirements of the fluid power actuators are ameliorated.

BRIEF DESCRIPTION OF THE DRAWING

Many objects and advantages of the present invention will be apparent to those skilled in the art when this specification is read in conjunction with the drawing wherein.

DESCRIPTION OF THE PREFERRED EMBODIMENT

Figure 1:
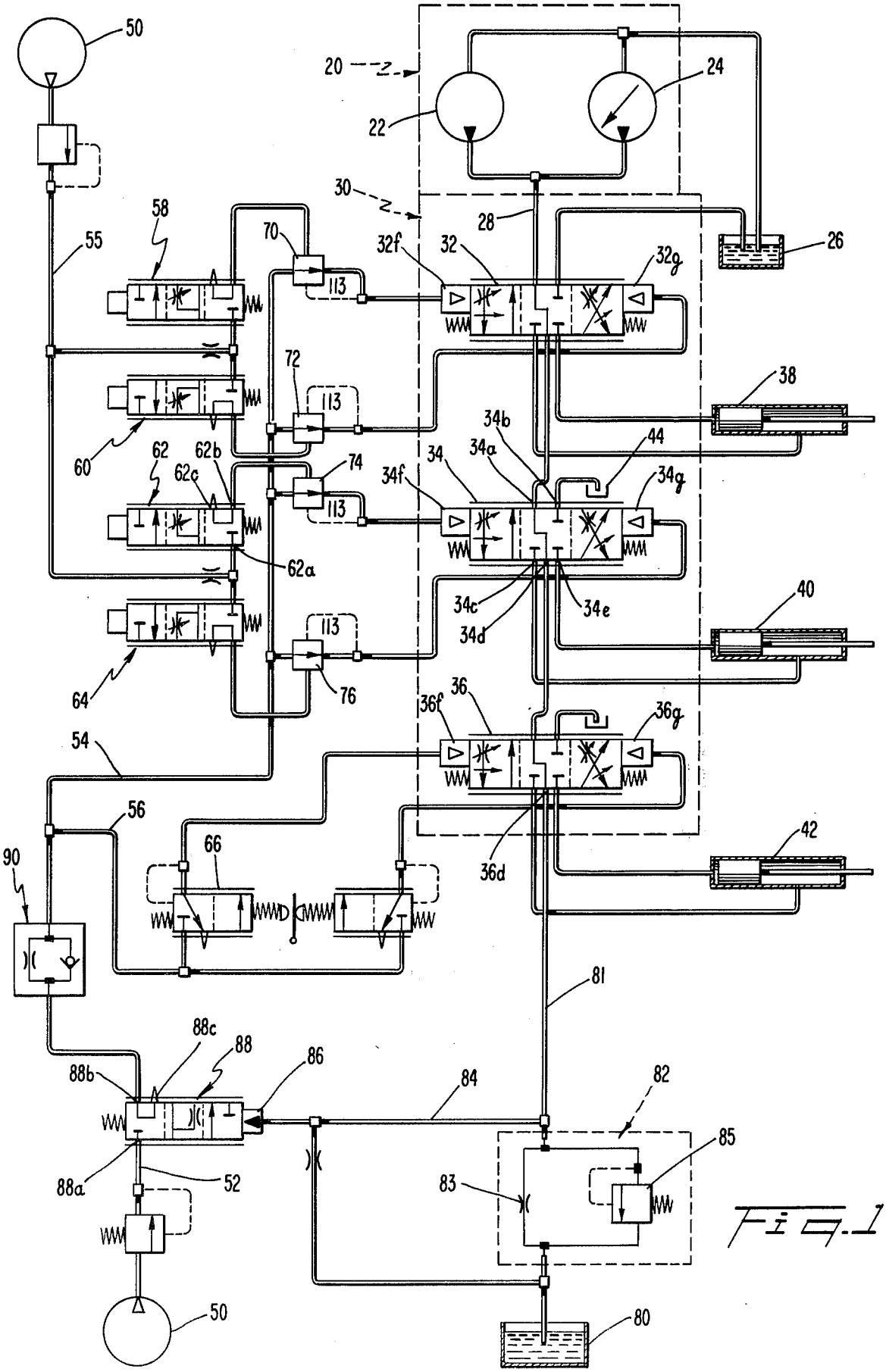
FIG. 1 is a schematic illustration of an hydraulic circuit constructed in accordance with the present invention.

Turning now to FIG. 1, a fluid power supply means 20 is illustrated which includes a fixed displacement pump 22 and a variable displacement pump 24. The two pumps 22, 24, are connected in parallel flow relationship between a reservoir 26 and a supply conduit 28. The fixed displacement pump 22 provides a continuous supply of fluid at a first flow rate which is constant. With the variable displacement pump 24 connected in parallel flow relationship with the fixed displacement pump 22, the fluid power supply means 20 is capable of providing a flow of pressurized fluid at a flow rate between a minimum value set by the first flow rate of the fixed displacement pump 22 and a maximum value defined by the combined maximum flow rates of the fixed displacement pump 22 and the variable displacement pump 24.

The fluid power supply means 20 provides a flow of hydraulic fluid through the conduit 28 to a valve stack 30 which includes three fluid power control valves 32, 34, 36. The first fluid power valve 32 controls the operation of a first fluid actuator 38 which may, for example, control articulation of an excavator bucket. The second fluid power control valve 34 controls a second fluid power actuator 40 which may, for example, control the articulation of an excavator boom. The third fluid power control valve 36 regulates the operation of a third fluid power actuator 42 which may, regulate the elevation of an excavator boom. Accordingly, it will be seen that each of the fluid power control valves 32, 34, 36, controls the operation of a corresponding hydraulic actuator 38, 40, 42.

The basic difference between each of the three fluid power control valves 32, 34, 36, relates to their respective capacity to handle hydraulic fluid. In this connection, the first fluid power control valve 32 has the lowest flow capacity requirement since it is connected with the bucket articulation fluid actuator 38. The second fluid power control valve 34 has a higher flow capacity since it is connected with the boom articulation control hydraulic cylinder 40. Finally, the third fluid power control valve 36 has the highest flow capacity of any of the fluid power control valves and is connected with the boom hoist cylinder 42. By arranging individual valves in the valve stack 30 such that the fluid power control valve with the lowest flow capacity, 32, is closest to the fluid power supply means 20 and the valve with the largest capacity is most remote from the fluid power supply means 20, the lower demand fluid actuators will be satisfied first and any deficiency between demand and supply will tend to be experienced by the hoist cylinder 42.

Returning now to the consideration of a typical fluid power control valve, each of the fluid power control valves is identical in construction, and a description of one will suffice as a description of each. Each fluid power control valve, e.g., 34, is a five-way, infinitely adjustable, pressure compensated, pneumatically actuated, open center control valve. The open center operation of the valve 34 is effected by fluid communication between power fluid input port **34*a* and power fluid exhaust port 34*d*. An exhaust port 34*b* is continuously connected to a reservoir 44 into which fluid is exhausted during actuation of the control valve 34** to either side of the neutral position shown.

The fluid power actuators are also similar and a description of one will identify the salient features of each. In this connection, the fluid power actuator 40 has a rod side chamber connected to power controlled port **34*c* and has a cylinder side chamber connected to controlled output port 34*e* of the control valve 34. Application of pneumatic pressure to pneumatic actuator 34*f* causes the control valve to move to the right and thereby causes communication between the port 34*a* and the port 34*c* and retracts the actuator. Conversely, the application of pneumatic actuator 34*g* moves the control valve 34 to the left establishing fluid communication between the port 34*a* and the port 34*e* so as to extend the fluid actuator 40**.

Pilot pressure for operating the pneumatic actuators **32*f*, 32*g*, 34*f*, 34*g*, 36*f* and 36*g* is supplied by a pneumatic power source 50 which may, for example, comprise a suitable conventional compressor capable of delivering air at a pressure of 90 psig. The pneumatic pressure source is connected to a conduit 52 having a pair of branch conduits 54, 56**.

The conduit 54 supplies pneumatic fluid to a plurality of 1:3 relay valves 70, 72, 74 and 76. Each of the 1:3 relay valves is connected to a corresponding pneumatic actuator of one of the fluid power control valves 32, 34. A number of pilot or thumb valves 58, 60, 62, 64, are each connected with the corresponding 1:3 relays and are each manually operable to control pilot pressure of the associated 1:3 relays 70, 72, 74, 76. Similarly, the manually actuated pilot valve 66 is connected to a corresponding one of the pneumatic actuators **36*f*, 36*g* and is operable to control extensional movement of the corresponding hydraulic actuator 42**.

Each of the pilot valves 58, 60, 62, 64 is essentially identical and it will, therefore, suffice to describe one of the pilot pressure control valves in detail. Turning now to the valve 62, the pilot pressure control valve is a manually operated, infinitely adjustable, three-way valve. The valve has three ports **62*a*, 62*b* and 62*c*. The first port 62*a* is connected with a corresponding supply conduit 55 from the low pressure source 50. The second port 62*b* is in communication with the corresponding 1:3 relay valve 74 which is connected in turn to the corresponding pneumatic fluid power control valve 34. The third port 62*c* is vented to atmospheric pressure at all times. As the valve 62 is manually depressed, pneumatic pressure is gradually introduced to the relay valve 74 so as to provide a varying force urging the spool of the fluid power control valve 34 to the right. Thumb valves 58, 60, 62 and 64 constantly bleed air while metering and therefore it is desired to operate them at reduced pressure since the 1:3 relays are used for boosting. Since valve 66** does not require a reduced pressure to control the valve it operates, it is supplied with same pressure as the 1:3 relays.

As the fluid power control valves 32, 34 require actuating forces of the same magnitude as the fluid power valve 36, the pneumatic pressure supplied to each pilot valve 58, 60, 62, 64, passes through a corresponding 1:3 relay 70, 72, 74, 76, wherein the pneumatic pressure is increased to about three times its pilot pressure. In this manner, one pressure source may be used to supply a plurality of fluid power control valves having different pilot pressure requirements.

It will be noted that during operation of the plurality of fluid power control valves 32, 34, 36, the relative magnitude of the fluid power demand as compared to the fluid power supply from the pump assembly 20 will be indicated by the rate at which pressurized hydraulic fluid leaves the port **36*d* of the last valve 36 in the series connected arrangement of the valve stack 30. The port 36*d* is connected directly to a tank 80** into which the fluid exhausts.

The flow rate of hydraulic fluid from the port **36*d* is measured by a flow rate measuring device 82 which is connected in series between the port 36*d* and the tank 80. The measuring device 82 includes a restriction 83 which establishes a pressure differential in the presence of a low hydraulic fluid flow. A relief valve 85 is connected in parallel with the restriction 83 to reduce pressure drops caused by high flows when less than full demand of the pump is being used by the control valves. The pressure differential comprises an hydraulic signal which is communicated through a conduit 84 to a hydraulic actuator 86 of a pneumatic pressure control valve 88. The pneumatic pressure control valve 88 is an hydraulically actuated, infinitely adjustable, three-way valve having two ports 88*a*, 88*b*, connected into the conduit 52 and a third port 88*c*** vented to atmospheric pressure.

So long as the flow rate of hydraulic fluid from the valve stack 30 to the conduit 81 has sufficient magnitude, a hydraulic signal is communicated to the hydraulic actuator 86 which urges the valve 88 to its full leftward position so as to provide no restriction in the communication between the pneumatic power source 50 and the 1:3 relay valves 70, 72, 74 76 and control valve 66. However, if the flow rate drops below the predetermined value, the strength of the hydraulic signal supplied to the hydraulic actuator 86 is reduced and the valve 88 moves to the right, thereby reducing the pneumatic pressure available to the relay valves 70, 72, 74, 76 and control valve 66.

A reduction in the supply pressure to the relay valves 70, 72, 74, 76 and control valve 66 causes a reduction in the actuating pressure actually applied to the associated fluid power control valves 32, 34, 36. Accordingly, a reduction in the pneumatic supply pressure is accompanied by a simultaneous and proportional repositioning of each fluid power control valve 32, 34, 36, so as to increase the resulting flow leaving the port **36*d* and entering the conduit 81. This readjustment of the control actuators continues until the flow rate through the conduit 81** has stabilized.

In order to reduce any tendency of unstable fluctuating corrections in the pneumatic supply pressure, a suitable conventional choke check valve 90 may be connected in series relationship with the control valve 88 downstream thereof and upstream of the relay and pressure control valve. The choke check valve adds stability to the interacting pneumatic and hydraulic systems so as to provide smooth adjustments of the control valves 32, 34, 36.

In operation, the various hydraulic motors 38, 40, 42, are actuated so as to either extend or retract by manually operating the corresponding pilot pressure control valves 58, 60, 62, 64, 66. In the event that the flow rate of hydraulic fluid demanded by the three fluid motors 38, 40 42 exceeds the maximum available flow rate of fluid produced by the fluid power supply means 20, the flow rate of hydraulic fluid from the valve stack 30 which enters the conduit 81 drops below a predetermined value. Accordingly, an hydraulic signal is passed to the hydraulic actuator 86 of the pneumatic pressure control valve 88 causing a corresponding reduction in the pneumatic pressure supplied to the relays 70, 72, 74, 76 and pilot control valve 66.

This pressure reduction is uniformly applied to each of the relays and pilot control valve 66 and passes through those valves to the associated fluid power control valve 32, 34, 36. As the pneumatic pressure actuating the control valves is thus reduced, the valve spools of the fluid power control valves 32, 34, 36, are simultaneously readjusted or repositioned in response to the lower pressure level in the pneumatic actuator. Accordingly, the total fluid flow rate demanded by the actuators is simultaneously reduced. This sequence of operation continues until the flow rate of fluid in the conduit 81 generates a sufficient hydraulic signal in the conduit 84 to maintain the pneumatic power control valve 88 in a constant position.

It will be observed that during the adjustment of the fluid power control valves 32, 34, 36, in response to the indicated excessive fluid flow rate demand, each of the hydraulic actuators 38, 40, 42, will continue to operate in the same relative manner but the rate of flow will be reduced proportionately between all of the actuators. Accordingly, there is virtually no chance that one of the actuators will receive a disproportionately high flow rate causing it to advance while the remaining actuators are essentially dormant.

Moreover, by using an open center valve stack, the fluid power source can be provided with a fixed minimum flow rate which continuously circulates through the hydraulic system. This fixed minimum flow rate is sufficiently high to position the pneumatic pressure control valve 88 in its fully open position. In this manner, the maximum pneumatic pressure is available for actuating the control valves. In addition, the fixed minimum flow rate is always on stream, readily available to begin fluid motor actuation without delay.

The use of 1:3 relay valves downstream of the pilot valves permits the use of a single source of pressurized pneumatic fluid thereby eliminating the problems otherwise associated with a controlling plurality of pressure sources.

By introducing a flow stabilizing mechanism 90 in the pneumatic pressure supply line, any tendency for fluctuating variations in the pneumatic supply line resulting from flow proportioning pressure adjustments can be minimized or eliminated.

It will now be apparent that, in accordance with the present invention, a fluid power control system has been provided which accommodates the excessive demand of hydraulic actuators relative to an hydraulic system which may include a constant displacement pump. Moreover, it will be apparent to those skilled in the art that many modifications, variations, substitutions and equivalents exist for the features of the present invention. Accordingly, it is expressly intended that all such modifications, variations, substitutions and equivalents which fall within the spirit and scope of the invention as defined in the appended claims be embraced thereby.

What is claimed is:

1. Control apparatus for proportioning a supply of fluid between a plurality of fluid actuators having a combined flow rate capacity exceeding the available flow rate of the fluid supply comprising:

fluid source means operable to supply pressurized fluid, having a minimum output flow rate greater than zero flow and a maximum output flow rate;

a plurality of fluid power valves connected in series-type fluid communication with the fluid source means, having a combined flow rate capacity exceeding the maximum output flow rate, each valve being pilot operated and constructed so that pressurized fluid moves downstream through the valve when the valve is in a neutral position;

pilot pressure source means operable to supply pressurized pilot fluid at a predetermined pressure;

a plurality of pilot control valves, each pilot control valve being in communication with the pilot pressure source means and a corresponding one of the plurality of fluid power valves, and operable to actuate the corresponding fluid power valve in response to movement of the pilot control valve; and sensing means operable to sense the flow rate of fluid exhausting from the plurality of fluid power valves and to effect a reduction in the predetermined actuation pressure when the sensed flow rate is below a preselected value, the reduced actuation pressure being operable to lower the flow rate required by the plurality of fluid power valves to the maximum output flow rate available so as to proportion the available flow between the plurality of fluid power valves.

2. The apparatus of claim 1, wherein the fluid source means includes:

a fixed displacement pump for providing the minimum flow rate; and a variable displacement pump adjustable between a maximum and a minimum output in accordance with the flow requirements of the plurality of fluid power valves.

3. The apparatus of claim 2 wherein the sensing means includes:

generating means operable to establish a fluid signal representing the output fluid flow rate; and control relay means operable to receive the fluid signal and to reduce the pressure of the actuating pressure source in response thereto.

4. The apparatus of claim 3 wherein flow stabilizing means is connected in communication with the plurality of relay valves and a pilot control valve downstream of the pilot pressure source means.

5. The apparatus of claim 1 wherein the sensing means includes:

generating means operable to establish a fluid signal representing the output fluid flow rate; and control relay means operable to receive the fluid signal and to reduce the pressure of the actuating pressure source in response thereto.

6. In an excavator having an articulatable boom and an articulatable bucket, an improved control system comprising:

an elevation actuator operable to raise and lower the boom;

an articulation actuator operable to articulate the boom;

a bucket actuator operable to articulate the bucket relative to the boom;

a fixed displacement pump having finite output flow rate;

a variable displacement hydraulic pump having a maximum output flow rate and being arranged in parallel flow relationship to the fixed displacement hydraulic pump;

a valve stack communicating with the fixed displacement pump and the variable displacement pump, operable to proportion the combined pump output flow rate between the elevation actuator, the articulation actuator and the bucket actuator, and including a first pilot operated valve communicating with the bucket actuator, a second pilot operated valve communicating with the articulation actuator, and a third pilot operated valve communicating with the elevation actuator, each valve having a corresponding maximum demand flow rate, constructed so that unused hydraulic fluid moves downstream through the valve, and the combined maximum demand flow rates for the three valves exceeds the sum of the finite output flow rate and the maximum output flow rate;

a pneumatic pressure source supplying pilot fluid at a predetermined pressure;

a plurality of pilot control valves, each pilot control valve being in communication with the pneumatic pressure source and a corresponding valve of the valve stack, and operable to actuate the corresponding valve in response to movement of the pilot control valve; and sensing means operable to sense the flow rate of fluid exhausting from the valve stack and to effect a reduction in the predetermined actuating pressure when the sensed flow rate is below a preselected value, the reduced actuating pressure being operable to lower the combined maximum demand flow rate of the valve stack to the sum of the finite output flow rate and the maximum output flow rate so as to proportion the available flow between the three valves of the valve stack.

7. The excavator of claim 6 wherein the sensing means includes:

generating means operable to establish a fluid signal representing the output fluid flow rate; and control relay means operable to receive the fluid signal and to reduce the pressure of the actuating pressure source in response thereto.

8. The excavator of claim 7 wherein flow stabilizing means is connected in communication with the plurality of relay valves and a pilot control valve downstream of the pneumatic pressure source means.

9. In a control apparatus for proportioning a supply of fluid between a plurality of fluid actuators having a combined flow rate capacity exceeding the available flow rate of the fluid supply, fluid source means operable to supply pressurized fluid, a plurality of fluid power valves connected in series-type fluid communication with the fluid source means, having a combined flow rate capacity exceeding the maximum output flow rate, pilot pressure source means operable to supply pressurized pilot fluid for actuating the fluid power valves at a predetermined pressure; the improvement comprising;

sensing means operable to sense the flow rate of fluid exhausting from the plurality of fluid power valves and to effect a reduction in the predetermined actuating pressure when the sensed flow rate is below a preselected value, the reduced actuating pressure being operable to lower the flow rate required by the plurality of fluid power valves to the maximum output flow rate available so as to proportion the available flow equally between the plurality of fluid power valves.

10. The apparatus of claim 9 wherein each of the fluid power valves is pilot-operated and constructed so that pressurized fluid moves downstream through the valve when the valve is in a neutral position.

* * * * *